US008671957B1

(12) United States Patent
James

(10) Patent No.: US 8,671,957 B1
(45) Date of Patent: Mar. 18, 2014

(54) HAIR CURLING DEVICE

(71) Applicant: Jeanne C James, San Juan Capistrano, CA (US)

(72) Inventor: Jeanne C James, San Juan Capistrano, CA (US)

( * ) Notice: Subject to any disclaimer, the term of this patent is extended or adjusted under 35 U.S.C. 154(b) by 0 days.

(21) Appl. No.: 13/738,571

(22) Filed: Jan. 10, 2013

(51) Int. Cl.
*A45D 2/20* (2006.01)
*A45D 2/16* (2006.01)
*A45D 2/18* (2006.01)

(52) U.S. Cl.
USPC ..... 132/247; 132/253

(58) Field of Classification Search
USPC ..... 132/247, 200, 210, 212, 222, 223, 226, 132/236, 240, 241, 243, 245, 250, 246, 265, 132/254, 270, 273, 275, 278, 333, 253, 255, 132/263, 266; D28/26, 35, 37; 473/579, 473/582, 390
See application file for complete search history.

(56) References Cited

U.S. PATENT DOCUMENTS

| | | | | | |
|---|---|---|---|---|---|
| 404,501 | A * | 6/1889 | Pfanne | 132/253 |
| 2,268,952 | A * | 1/1942 | McElwain | 132/253 |
| 2,452,225 | A * | 10/1948 | Coloccia | 132/247 |
| 2,555,933 | A * | 6/1951 | Renstrom | 132/247 |
| 2,626,805 | A * | 1/1953 | Carlton | 473/579 |
| 2,678,654 | A * | 5/1954 | Schneebeli | 132/228 |
| 2,713,864 | A * | 7/1955 | Solomon | 132/253 |
| 5,033,487 | A * | 7/1991 | Barradas | 132/254 |
| 5,076,299 | A * | 12/1991 | Wistrand et al. | 132/253 |
| D325,104 | S * | 3/1992 | Wistrand | D28/37 |
| 5,890,496 | A * | 4/1999 | Habibi | 132/210 |
| 6,427,701 | B1 * | 8/2002 | Roth | 132/245 |
| 6,990,986 | B2 * | 1/2006 | Valentini | 132/245 |
| 2004/0163660 | A1 * | 8/2004 | Kellmann | 132/201 |
| 2004/0206368 | A1 * | 10/2004 | Warner et al. | 132/200 |
| 2008/0099036 | A1 * | 5/2008 | Crowley et al. | 132/275 |
| 2009/0145452 | A1 * | 6/2009 | Anderson et al. | 132/202 |
| 2009/0255549 | A1 * | 10/2009 | Smith | 132/245 |
| 2010/0051044 | A1 * | 3/2010 | Pearson | 132/210 |
| 2012/0227757 | A1 * | 9/2012 | Fardoe | 132/210 |

* cited by examiner

*Primary Examiner* — Vanitha Elgart
(74) *Attorney, Agent, or Firm* — Raymond Sun

(57) ABSTRACT

A hair curling device has a flexible flat base portion, a stem having a bottom end secured to the base portion, and a bowl portion having a frusto-conical wall extending upwardly from a top end of the stem in an open position. The frusto-conical wall has a top edge and a flange extending from the top edge, the frusto-conical wall adapted to be folded over in position around the stem so as to enclose the stem and the base portion in a folded position where the flange of the frusto-conical wall extends around the outer edge of the base portion and is aligned with the bottom of the base portion. The base portion, the stem and the bowl portion are made in one piece from a silicone material. The frusto-conical wall has a greater thickness in a region adjacent the stem than the thickness along the rest of the frusto-conical wall.

4 Claims, 5 Drawing Sheets

HAIR CURLING DEVICE

BACKGROUND OF THE INVENTION

1. Field of the Invention

The present invention is directed to hair curling devices, and in particular, to a flexible hair curling device which allows the hair to be wound during the curling operation and held on the scalp.

2. Description of the Prior Art

Various forms of hair curling devices have been made available in the market, including hair curling apparatus of more or less complexity by which the hair is subjected to fluid treatment followed by a heat treatment at uncomfortably high temperatures for substantial periods of time. Various devices for holding curls in place have also been employed for cold wave treatment, such as bobby pins and various other forms of curl holding fasteners, but none of these devices have proved entirely successful.

U.S. Pat. No. 2,452,225 describes a known curling device. Unfortunately, the curling device described in U.S. Pat. No. 2,452,225 suffers from a number of drawbacks. For example, the bowl portion often pops open from its folded position to its unfolded position. The natural rubber material is prone to stress cracking, hardening, does not retain its shape if compressed, and is uncomfortable to sleep in. In addition, the curling device is not properly retained in the desired location of the scalp, as it often tends to slide down the user's hair.

SUMMARY OF THE DISCLOSURE

One of the objects of the present invention is to provide a form of curling device which may be used by inexperienced persons without the use of bobby pins or various other forms of curl holding fasteners for the making of ordinary curls or permanent curls.

Another object of the invention is to provide a form of hair curling device which may be made at a low cost and which is adapted to be used at home with safety and ease in curling the hair.

Another object of the invention is to provide a form of a non-electric hair curling device which operates without heat, to prevent damage to hair.

Another object of the present invention is to provide a form of curling device which may be made of a flexible durable long-lasting material which will be unaffected by oils and chemicals normally used in the curling of hair and which may be effectively retained in place on the scalp with comfort while sleeping.

Yet another object of the present invention is to provide a form of curling device which is adapted to be open while curls are being formed on one portion of the device and which may be effectively closed or folded over the formed curls with provisions for ventilation or permitting air to come in contact with the curls, as well as permitting vaporization of the moisture from the curls while held in place in the device.

To accomplish the objectives set forth above, the present invention provides a hair curling device having a flexible flat base portion, a stem having a bottom end secured to the base portion, and a bowl portion having a frusto-conical wall extending upwardly from a top end of the stem in an open position. The frusto-conical wall has a top edge and a flange extending from the top edge, the frusto-conical wall is adapted to be folded over in position around the stem so as to enclose the stem and the base portion in a folded position where the flange of the frusto-conical wall extends around the outer edge of the base portion and is aligned with the bottom of the base portion. The base portion, the stem and the bowl portion are made in one piece, preferably from a silicone material. The frusto-conical wall has a greater thickness in a region adjacent the stem than the thickness along the rest of the frusto-conical wall.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 2:
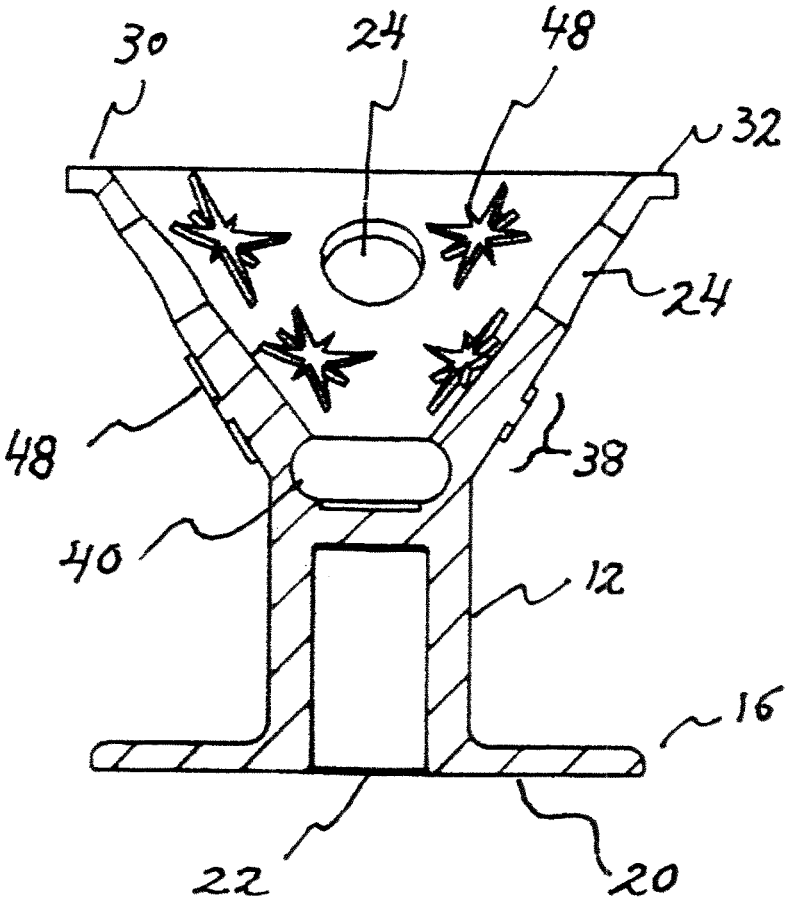
FIG. 2 is a cross-sectional view of the curling device of FIG. 1 in an open position.
Figure 3:
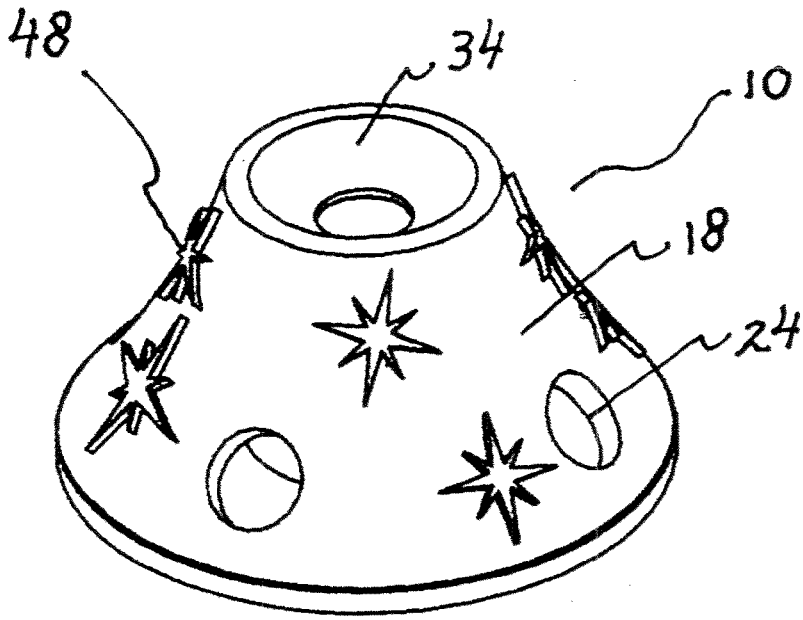
FIG. 3 is a perspective view of the curling device of FIG. 1 shown in a folded position.
Figure 4:
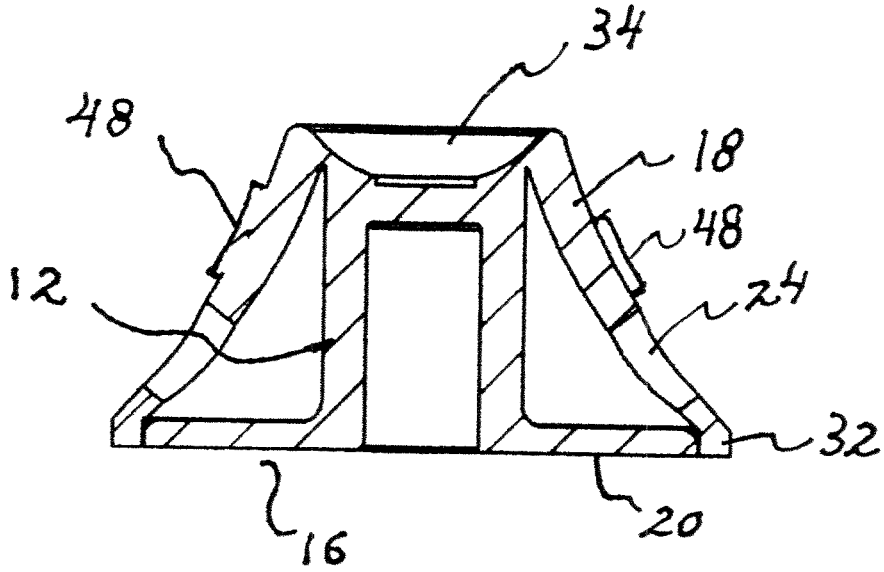
FIG. 4 is a cross-sectional view of the curling device of FIG. 1 in a folded position.

Referring to FIGS. 1-4, the curling device 10 of the present invention has a stem 12 that connects a foldable bowl portion 14 and a base portion 16. The base portion 16 is preferably circular so as to readily seat on the part of the scalp S (see FIG. 5) adjacent the strand of hair which is to be curled. The bowl portion 14 has a frusto-conical wall 18 that is adapted to be folded over the stem 12 so as to enclose the stem 12 and the base portion 16. The frusto-conical wall 18 has a top edge 30 and a circular flange 32 extending therefrom. The frusto-conical wall 18 of the bowl portion 14 has a length so that in the folded position, it reaches the bottom 20 of the base portion 16, as best shown in FIG. 4.

As best shown in FIGS. 2 and 4, the stem 12, the bowl portion 14 and the base portion 16 can all be made in one piece of the same material. The material is preferably a silicone material. In one embodiment, the silicone material can be SILASTIC® 25140 silicone rubber, which is made by Dow Corning Corporation of Midland, Mich. This material is a general purpose silicone rubber compound that has the following characteristics:

Durometer—Shore A=40 Shore A
Elongation=705%
Specific Gravity @ 25C=1.11
Tear Strength=80 ppi
Tensile Strength=1170 psi The use of silicone for the material provides numerous advantages over the prior art devices. For example, silicone is hygienic, hypoallergenic, odorless, non-toxic, withstands extreme temperature applications (−148° F. to 600° F.), and is flexible in a manner where it retains its shape if compressed. Silicone also withstands continuous flexing without stress cracking.

In addition, the material for the entire curling device 10 can be impregnated with a "glow-in-the-dark" compound or phosphorescent pigment, such as a Zinc Sulfide compound, an example of which is the "NightGlo™ NG-200" made by Day-Glo Color Corp., of Cleveland, Ohio. This allows the curling device 10 to be visible in the dark, thereby adding amusement value to the curling device 10.

The stem 12, bowl portion 14 and base portion 16 can be constructed so that the stem 12 is generally hollow with an opening 22 at the center of the base portion 16. The base portion 16 is planar and is essentially like a circular flange that extends from the stem 12. The diameter of the base portion 16 can vary depending on the desired size of the curling device 10, although the dimensions of the stem 12 and the bowl portion 14 must be adjusted accordingly so as to allow the frusto-conical wall 18 of the bowl portion 14 to reach the bottom 20 of the base portion 16 in the folded position as shown in FIG. 4, where the flange 32 (see below) extends around the outer edge of the base portion 16 and is aligned with the bottom 20. This arrangement helps to keep the hair inside the curling device 10 and to prevent the hair from unwinding out of the base 16 and sliding down the user's hair. As a non-limiting example, if the base portion 16 has a diameter of 1.223 inches and a uniform thickness of 0.06 inches, the stem 12 can have a diameter of 0.449 inches, and a height of 0.649 inches, with the cylindrical wall of the stem 12 having a thickness of 0.0965. Again, these dimensions are proportionate, so a larger curling device 10 will have proportionately larger dimensions, and a smaller curling device 10 will have proportionately smaller dimensions.

In order to permit air to circulate to the curled hair around the stem 12, a plurality of openings 24 are provided in the frusto-conical wall 18 and the base 16. These openings 24 also permit vaporization of moisture from the hair. These openings 24 can be positioned randomly, or in a specific arrangement, about the frusto-conical wall 18 and base 16, and can be varied in size and shape.

In addition, a plurality of raised patterns 48 are provided on both the interior and exterior surfaces of the frusto-conical wall 18. These raised patterns 48 can take the form of any shape, and are illustrated in the drawings as being star-shaped. These raised patterns 48 help to keep the hair from sliding down the frusto-conical wall 18 and from slipping out of the curling device 10.

The frusto-conical wall 18 is provided with a varying thickness. Referring to FIG. 2, the frusto-conical wall 18 has its greatest thickness at a region 38 adjacent its base where it extends from the top of the stem 12, and its smallest thickness adjacent its top edge 30, from which the circular flange 32 extends. The thickness of the frusto-conical wall 18 gradually decreases from the region 38 to the top edge 30, or the decrease can be incremental or varied in another manner. As a non-limiting example, for a curling device 10 with the dimensions set forth above, the thickness of the frusto-conical wall 18 can be 0.092 inches at the region 38, and 0.067 inches adjacent its top edge 30. The increased thickness at the region 38 helps to keep the bowl portion 14 locked in the folded position, and not as prone to popping open from its folded position to its unfolded position. Therefore, the thickness of the frusto-conical wall 18 at the region 38 can be adjusted. For example, in the curling device 10 described above, the thickness of the cylindrical wall of the stem 12 is very slightly larger than the thickness of the frusto-conical wall 18 at the region 38, but it is also possible to provide the thickness at the region to be slightly greater than the thickness of the cylindrical wall of the stem 12.

A concavity 34 is defined at the bottom of the frusto-conical wall 18, as best shown in FIGS. 3-4, to define a the transition region 40 between the stem 12 and the frusto-conical wall 18 that is preferably very thin (e.g., 0.046 inches), so as to allow for the folding action of the frusto-conical wall 18.

Figure 5:
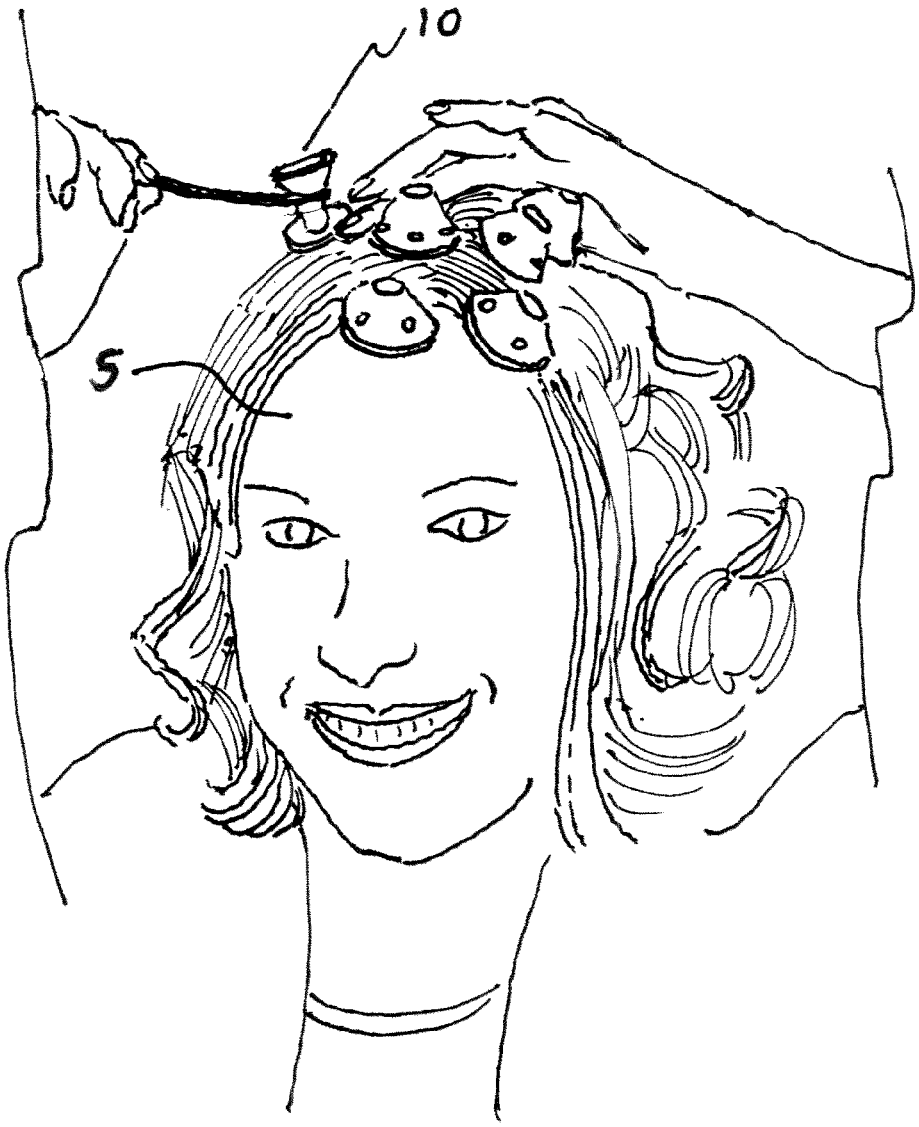
FIG. 5 illustrates the use of the curling device of FIG. 1 in a user's hair.

In use, the base portion 16 is first placed in contact with the scalp S adjacent the strand or tuft of hair which is to be curled. The strand is then wound around the stem 12, beginning at the base of the stem 12 and winding spirally upwardly while the bowl portion 14 remains in the open position shown in FIGS. 1 and 2. After the curl is in place, it is held in position by a finger or thumb, while the bowl portion 14 is folded down over the curl, by which it is retained as shown in FIGS. 3-5 in the folded position. The hair may be retained in position on the curling devices 10 overnight or for any suitable amount of time such as to allow dry hair to achieve the desired tightness of curl, or damp hair to evaporate moisture and a relatively permanent set of curl is obtained.

Figure 1:
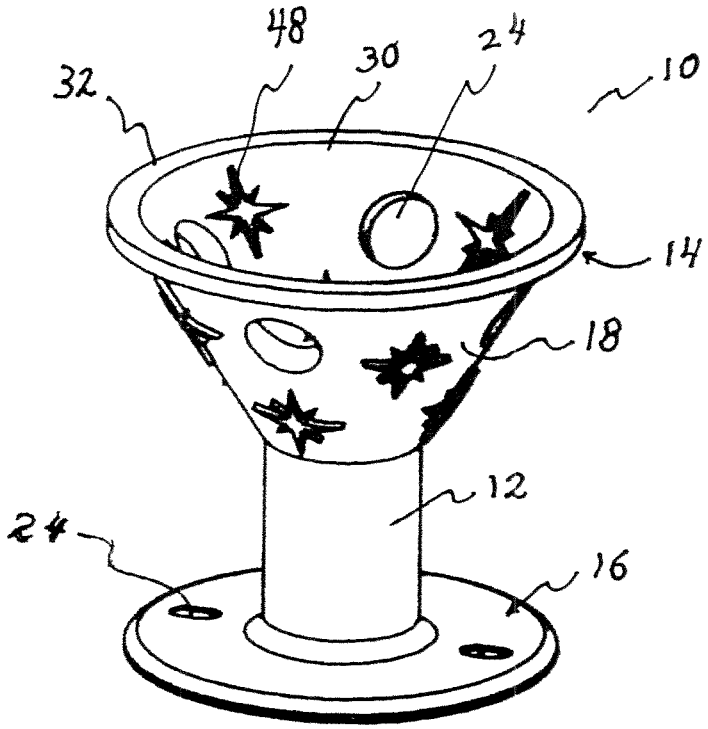
FIG. 1 is a perspective view of a curling device in accordance with a first embodiment of the present invention shown in an open position.

After the curling operation is completed and the dry hair has been suitably curled, or the damp hair suitably dried and curled, the bowl portion 14 is first inverted into the open position shown in FIGS. 1 and 2. The curl is then held in place by fingers in its position in a plane parallel to the scalp S while the curling device 10 is removed. To remove the curling device 10, the base portion 16 can be bent into a conical configuration so that the base portion 16 can pass through the curl without disarranging any part of the curl, or the hair can be unwound from the stem 12.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A hair curling device, comprising:

a flexible flat base portion having an outer edge and a bottom;

a stem having a top end, and a bottom end secured to the base portion; and a bowl portion having a frusto-conical wall extending upwardly from the top end of the stem in an open position, the frusto-conical wall having a top edge and a flange extending from the top edge, the frusto-conical wall adapted to be folded over in position around the stem so as to enclose the stem and the base portion in a folded position where the flange of the frusto-conical wall extends around the outer edge of the base portion and is aligned with the bottom of the base portion;

wherein the base portion, the stem and the bowl portion are made in one piece from a silicone material, the frusto-conical wall having a thickness that gradually decreases from a region adjacent the stem along the rest of the frusto-conical wall to the flange where the thickness is the smallest.

2. The device of claim 1, wherein the material is impregnated with a phosphorescent pigment.

3. The device of claim 1, wherein the bowl portion has a bottom, and a transition region is defined between the bottom of the bowl portion and the top end of the stem, with a concavity defined adjacent the transition region, with the thickness of the material adjacent the transition region being less than the thickness of the frusto-conical wall in the region adjacent the stem.

4. The device of claim 1, wherein the stem has a cylindrical wall, and the region of the frusto-conical wall has a greater thickness in the region adjacent the stem than the thickness of the cylindrical wall of the stem.

* * * * *